United States Patent [19]

Hegarty

[11] Patent Number: 4,925,145

[45] Date of Patent: May 15, 1990

[54] DOCUMENT SUPPORT STAND AND SECURABLE INTERLOCKING DOCUMENT HOLDER WITH LOCKING DOCUMENT RETAINER

[76] Inventor: David Hegarty, 36 Wyatt Rd., Garden City, N.Y. 11530

[21] Appl. No.: 276,932

[22] Filed: Nov. 28, 1988

Related U.S. Application Data

[63] Continuation-in-part of Ser. No. 45,630, May 1, 1987, Pat. No. 4,787,595, which is a continuation-in-part of Ser. No. 791,743, Oct. 28, 1985, abandoned.

[51] Int. Cl.[5] ..... A47G 1/24; 248 454

[52] U.S. Cl. ..... 248/454; 248/447; 248/458

[58] Field of Search ..... 248/454, 455, 456, 450, 248/451, 452, 453, 447, 447.2, 295.1, 296, 298, 551; 402/70, 75, 73; 403/381, 375, 354, 331; 281/47, 48; 70/90

[56] References Cited

U.S. PATENT DOCUMENTS

| | | | |
|---|---|---|---|
| 2,325,155 | 7/1943 | Wedge | 402/75 |
| 3,043,047 | 7/1962 | La Fleur | 248/454 |
| 3,267,940 | 8/1964 | La Fleur | 129/38 |
| 3,366,359 | 1/1968 | Wolf et al. | 248/447 |
| 3,425,421 | 2/1969 | Feder | 281/48 |
| 3,968,985 | 7/1976 | Nielsen, Jr. et al. | 292/340 |
| 4,009,599 | 3/1977 | Patriquin | 70/90 |
| 4,462,317 | 7/1984 | Franko et al. | 109/45 |
| 4,582,442 | 4/1986 | Rager | 402/75 |
| 4,583,877 | 4/1986 | Wilson | 402/75 X |
| 4,722,627 | 2/1988 | Salacuse | 402/75 |
| 4,787,595 | 11/1988 | Hegarty | 248/454 |

*Primary Examiner*—Ramon O. Ramirez

[57] ABSTRACT

A document support stand for removably mounting and locking a document holder on the stand includes a main body which may be formed in the shape of a rectangular solid. The body includes a viewing side having an elongated bracket defining a T-slot mounted on it or formed in its surface. Additionally, the stand includes an aperture formed in its body to cooperate with a lock carried by the document holder. The document holder includes an elongated member configured as a T-shaped rail which is slidably received by the bracket of the stand so that the document holder may be mounted on the stand. The document holder further includes a plunger lock which has the dual function of locking the holder to the stand and, at the same time, of locking the rings of the mounted loose-leaf binder in a closed position.

17 Claims, 5 Drawing Sheets

DOCUMENT SUPPORT STAND AND SECURABLE INTERLOCKING DOCUMENT HOLDER WITH LOCKING DOCUMENT RETAINER

CROSS-REFERENCE TO RELATED APPLICATION

This application is a continuation-in-part of copending prior application filed Nov. 18, 1988, which is a continuation-in-part of copending prior application Ser. No. 045,630 filed May 1, 1987, now U.S. Pat. No. 4787595 which is a continuation-in-part of prior application Ser. No. 791,743 filed Oct. 28, 1985, now abandoned.

BACKGROUND OF THE INVENTION

1. Field of The Invention

This invention relates to lockable document support devices, and more particularly to a stationary document support stand having a selection of interchangeable document holders which include a lockable document retaining ability that can be selectively, and securely, interlocked with the stationary stand while supporting documents in one or more viewing dispositions.

2. Description of The Prior Art

The term "document" hereinafter refers to a single page or a multiple number of pages.

The term "document holder" hereinafter refers to that type of device, which is adapted to lockably retain a document, such as in a loose-leaf binder or the like, which are modified in accordance with the principles of this invention.

The term "interlocking" hereinafter refers to the engagement of mutually cooperating members.

The term "secure" hereinafter refers to preventing the unauthorized removal of a document holder from the stand by means of a lock or other kind of restraining device, such as will be described, which are modified in accordance with the principles of this invention.

The term "retaining" herein refers to holding a document either by gripping or going thru the surface of the document.

To my knowledge the most recent art which applies somewhat to the inventive concept of this application can be found in my copending, continuation-in-part patent application entitled "MULTI-POSITIONABLE DOCUMENT SUPPORT STAND AND INTERLOCKING MODULAR DOCUMENT HOLDER" filed Nov. 18, 1988 the disclosure of which is hereby incorporated by reference. Although this copending application does disclose a document holder, such as a loose-leaf binder, having a locking means for securing the holder to a document support stand it does not provide for the document holder having the dual ability to secure itself as well as the documents mounted thereon. There is disclosed therewithin a document support stand and interlocking document holder for mounting on the stand. The disclosure further shows a document holder of the loose-leaf binder type having an operable slide member for controlling the opening and closing of the binder retaining rings mounted on the document holder. The disclosure provides for the securable mounting of the holder, and its closed rings, by having a separate locking device being mounted on the stand and to slidably approach the mounted binder and its operable slide member, abutting the same, thereby preventing movement of parts and thus providing for the security of both the document holder and the documents mounted thereon.

The prior art discloses many other attempts at securing documents. Devices adapted to secure documents for viewing are well known and come in a variety of structural types. They are designed to secure a document having either a page or a number of pages. Considering the former, attempts at securely presenting a single page for public reference are quite varied. Often the page is just tacked to a wallboard or put in a locked wall cabinet having a glass viewing door.

Attempts at securing bound documents are also well known. Very often the solution is to attach the document binding device to a counter type stand by means of a chain with little attention to securing the document retaining device which controls the opening and closing of the binder rings. Other methods are quite popular as well. For example, the prior art discloses a number of devices which attempt to prevent the removal of bound documents. Catalog stores use devices similar to La Fleur's Lock Device For Binder, Pat. #3,267,940, which secures a document to a surface via the cooperation of screws and a restraining rod being removably clamped to secure the document. Other methods adapt standard metal binder devices, such as the post type, for the same purpose.

Another well known method for securing a bound document is a stand used to securely hold telephone books for public reference. Although this device is excellent for its intended purpose it is limited in many ways. By its nature, the ability to remove and replace the document is difficult and cumbersome. The addition or deletion of individual pages is not provided for. Such a stand is not designed nor intended to present text both perpendicular and parallel to the spine of the bound document. Additionally, the stand is limited in purpose since it is not capable of supporting other types of document holders.

Such devices have many disadvantages when considered collectively. Some obvious disadvantages are: (a) the types of securing devices are numerous (b) securing the devices requires an assortment of specific hardware and is time consuming, thus being economically wasteful, (c) although secured, many document holders permit the easy removal of the documents which they hold, (d) for those devices which provide a high degree of security, changing the documents is both time consuming and limited to securing a specific type of document.

The prior art is devoid of cooperating devices which mutually support and secure documents having different mounting requirements.

The prior art lacks a simple and easily manufactured, securable document support stand which is economical in purpose.

The prior art utilizes crude and inefficient security methods for replacing and restraining documents.

OBJECTS AND SUMMARY OF THE INVENTION

It is object of this invention to provide an interlocking, lockable document holder retaining device that carries its own locking mechanism for securing both the document holder and the document it retains to a document support stand.

It is another object of the present invention to provide a mountable, lockable document retaining device that is easily mounted on, secured, and removed from, a document support stand.

It is yet another object of the present invention to provide a support stand for locking loose-leaf binders and the binder's retaining rings which is simple in construction and easily manufactured.

It is a further object of the present invention to provide a support stand and document holder, where the holder includes a mechanism for lockably restraining documents, which mechanism may be unlocked permitting the holder to remain mounted on the support stand while also permitting the insertion or removal of documents.

It is yet a further object of the present invention to provide a document support stand which locks the document holder and its documents to the stand allowing the face of one or two individual documents to be in full view and to be positioned for viewing parallel to the viewing surface.

It is a further object of the present invention to provide a stationary document support stand which overcomes the inherent disadvantages of known document restraining devices.

In accordance with one aspect of the present invention, the document support stand includes a main body which may be formed in the shape of a rectangular solid. The body has a viewing side and a support side for supporting the stand on a desk, counter top, or other support surface. The main body of the stand includes a mounting device for removably mounting a document holder on the body. The mounting device is secured to the viewing side of the main body.

In a preferred form of the invention, the mounting device is an elongated bracket, C-shaped in cross-section, which defines a T-slot having an exposed open end. The bracket is mounted in a recess formed across the surface of the main body's viewing side.

According to the present invention, an interlocking and lockable document holder retaining device, such as a lockable document holder of the loose-leaf binder type, includes a document retainer (for example, the retaining rings of the binder), a retaining mechanism (for example, the binder mechanism), a mechanism control device (for example, the operable slide member of the binder), support for the retaining mechanism (for example, the base member on which the binder mechanism is mounted), a lock, a lock receiving means (such as the hole formed in the flange member) and an elongated member for mounting the document holder on the support stand. The elongated member in its preferred form is T-shaped in cross-section and, in the example above of a loose-leaf binder-type document holder, is mounted on the spine of the binder's jacket. The T-shaped member of the holder is slidably received by the C-bracket of the stand through the C-bracket's exposed open end, so that the document holder may be secured to the viewing side of the stand's main body.

Thus the invention provides for the easy and efficient mounting and locking of a binder and its documents on a document support stand, simply by sliding the binder on the stand and pushing a lock, allowing the free turning of pages, while permitting the pages of the binder to be completely viewed, parallel to the viewing surface, and yet protecting the binder and its pages from unauthorized removal.

These and other objects, features and advantages of this invention will be apparent from the following detailed description of illustrative embodiments thereof, which is to be read in connection with the accompanying drawings.

DETAILED DESCRIPTION OF THE PREFERRED EMBODIMENTS

Figure 1:
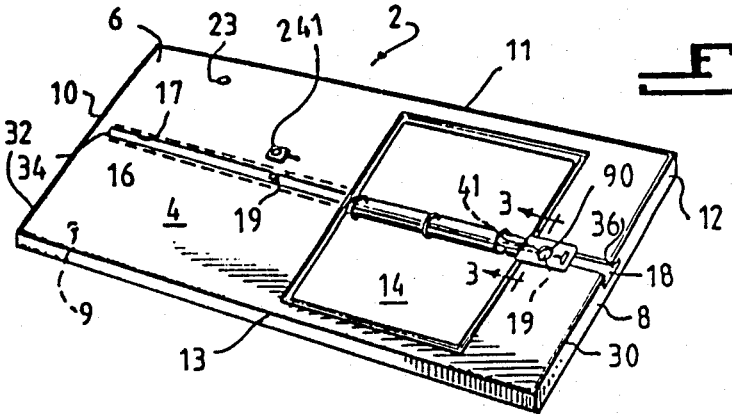
FIG. 1 is a front perspective view of a document support stand having a lockable loose-leaf binder constructed in accordance with one form of the present invention.
Figure 2:
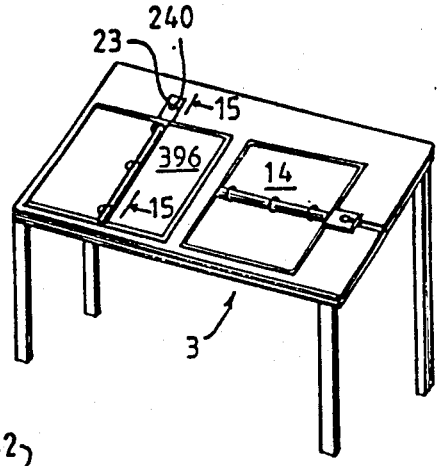
FIG. 2 is a front perspective view of a counter type stand having the document support stand formed within constructed in accordance with another form of the present invention.

Initially referring to FIGS. 1 and 2, it will be seen that a document support stand 2, constructed in accordance with one form of the present invention, includes a main body 4 formed in the shape of a rectangular solid. The main body 4 may be formed as a flat board, if desired, and although it may be supported at any angle, including vertically, by a support bracket or the like, it may also be horizontally mounted on a table top.

In this form of the invention, the main body 4 includes six planar, rectangularly shaped surfaces: viewing side 6, back support side 8 opposite to viewing side 6 and four support edges or surfaces 10, 11, 12, 13. The viewing side 6 being planar in nature, provides a flat surface for holding and viewing a document mounted thereon, as will be explained. The body has a flat, planar back support side 8 opposite viewing side 6 which is provided for attaching the stand to a complementary receiving flat surface. Back side 8 is provided with receiving holes 9 to receive screws to attach stand 2 to a receiving surface. Of course it is envisioned that the stand 2 may be formed in the top surface of a desk, counter type table 3 at time of manufacture of the same as shown in FIG. 2.

The viewing side 6 is preferably rectangular in shape, and of sufficient dimensions to adequately support a loose-leaf binder or other document holder as shown in FIG. 2. The size of the stand, and its viewing side, is selected to fit the needs of the user and the number of document holders envisioned to be supported.

Figure 3:
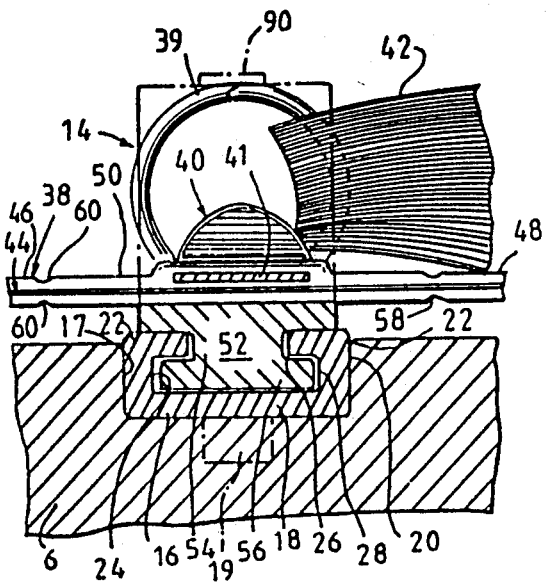
FIG. 3 is a fragmentary sectional view of the document support stand and the lockable loose-leaf binder shown in FIG. 1, taken along line 3—3 of FIG. 1.
Figure 3A:
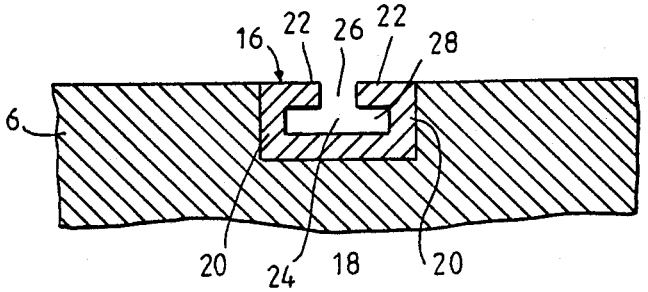
FIG. 3A is a fragmentary sectional view of the document support stand shown in FIGS. 1 and 2, illustrating one side of the viewing side thereof.
Figure 3B:
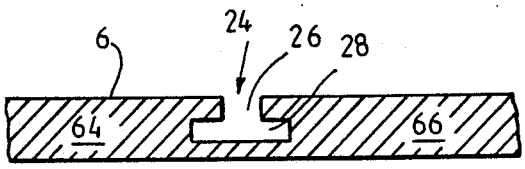
FIG. 3B is a fragmentary sectional view of the document support stand shown in FIGS. 1 and 2, illustrating another form of the viewing side thereof.

The document support stand 2 further includes provision for mounting a document holder such as lockable loose-leaf binder 14 on the main body 4 as shown in FIG. 1. In one form of the invention, an elongated bracket 16 having a C-shape in cross-section is mounted in a recess 17 formed in the surface of the viewing side 6 of the body 4. As shown in FIGS. 3, 3A, 3B, the bracket 16 includes a back plate 18, a pair of side plates 20 joined to the back plate 18 on the back plate's opposite transverse edges and extending perpendicularly from the back plate on the same side of the back plate, and a pair of inwardly facing arms 22, each arm 22 being joined to a respective side plate 20 and being spaced apart from the back plate 18.

The C-bracket 16 defines an elongated, T-shaped slot 24, having narrowed and widened portions 26, 28. The narrowed portion 26 of the T-slot 24 is defined between the pair of arms 22, while the widened portion 28 of the T-slot 24 is defined between the back plate 18 and each arm 22.

The bracket 16 is mounted on the main body 4 of the stand 2 with its back plate 18 abutting against the recessed surface of the viewing side 6. Fasteners, glue or other means may be employed to mount the bracket 16 in the recess 17.

The C-bracket 16 mounted in the recessed surface of the viewing side 6 may extend entirely across the viewing side, or may extend from one edge of the viewing side (shown in FIG. 1 as proximate edge 30) and terminate before reaching the opposite distal edge 32. The terminated edge 34 of the bracket 16 defined by the end of the recess 17 provides a stop, which limits the extent to which the lockable binder 14 may be received by the bracket 16.

As mentioned above, at least one end 36 of the bracket 16 extends to an edge of the viewing side 6. Thus, this end 36 is exposed, and is open to the slot 24 so that a document holder 14 may be slidably received by the slot through the exposed open end 36.

For the purpose of clarity the description of the proper mounting of lockable binder 14 will be presented in two phases. First, the mounting of the binder on the stand, secondly, the structure and engagement of the locking mechanism.

FIG. 3, in association with FIGS. 1 and 2 illustrates one form of a lockable binder 14 constructed in accordance with the invention, and demonstrates how that document holder is initially mounted and interlocked on the document support stand 2.

Loose-leaf binder 38, having a binder mechanism 40 with ring members 39 to hold pages or documents 42, and a jacket 44 having a front and back cover 46, 48, with the binder mechanism 40 mounted on the inside surface of the jacket at its spine 50, is modified to further include an elongated rail 52 mounted on the outside surface of the jacket 44 at or near the spine 50. The elongated rail 52 has a T-shape in cross-section with narrowed and widened portions 54, 56 that correspond in dimensions to the widened and narrowed portions 28, 26 of the slot 24 defined by the C-bracket 16. The T-rail 52 may include a back plate 58 mounted on the narrowed portion 54 and spaced from its widened portion 56 for mounting the rail on the loose-leaf binder jacket, such as by gluing, fasteners or other means. Or, the T-rail 52 may be integrally formed with the jacket when the loose-leaf binder is made. It is also envisioned to have the loose-leaf binder mechanism 40 mounted directly to back plate 58 thereby eliminating the jacket 44.

As shown in FIGS. 1 through 3, the loose-leaf binder-type document holder 14 is removably mounted on the document support stand 2 by sliding its T-rail 52 through the exposed end 36 of the C-bracket 16 into the bracket's T-slot 24 until the document holder is positioned on the viewing side 6 to cooperate with hole 19 or recessed cavity formed in the body of stand 6. The purpose of hole 19 or recessed cavity will be explained below.

The C-bracket 16 of the stand 2 securely holds the document holder 14 and supports it at its spine 50. Of course, it is also envisioned to be within the scope of this invention to eliminate a separate C-bracket member 16 and to form the T-slot 24 directly in the surface of the viewing side 6, as illustrated by FIG. 3B. In such a case, the narrowed and widened portions 26, 28 of the T-slot 24 are defined by first and second portions 64, 66 of the viewing side, the first and second portions 64, 66 being L-shaped and in relative mirror image disposition, as illustrated.

Figure 4:
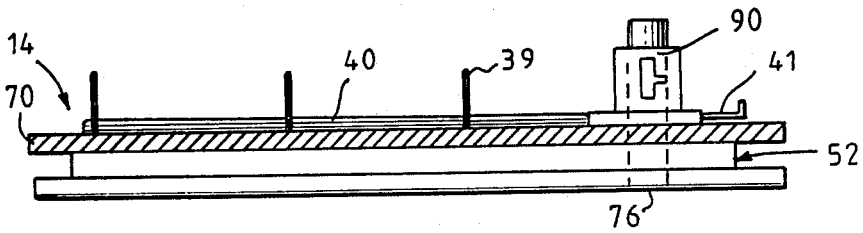
FIG. 4 is a side elevational view of the lockable loose-leaf binder of the present invention.

The locking feature of the preferred embodiment will now be described. Referring initially to FIG. 4 lockable loose-leaf binder 14 basically consists of three major components: base member 70, ring mechanism 40 having ring members 39 with operable slide member 41 and locking mechanism 90 with both mechanism mounted on base member 70.

Figure 5:
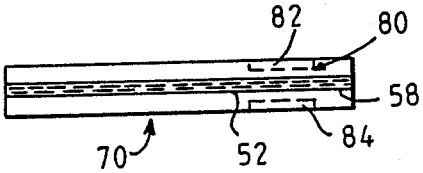
FIG. 5 is a bottom plan view of the basemember shown in FIG. 4.
Figure 5A:
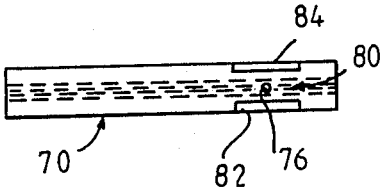
FIG. 5A is a top plan view of the basemember shown in FIG. 5.

FIG. 5 shows that the bottom of base member 70 consists of base plate 58 formed in the lower surface of base member 70 supporting T-rail cooperating means 52 for mounting binder 14 on support stand 2 previously described. FIG. 5A shows that base member 70 has channel section 80 formed near the proximate end of the upper surface of member 70 with channel section 80 formed in the upper surface of base member 70 and setback from the proximate end of base member 70. The upper surface being on the opposite side of where rail 52 resides. The channel section 80 consists of two parallel walls 82, 84 being formed along the longitudinal edges of member 70 and being of sufficient height and thickness to permit the passage of operable slide member 41 between the two. Walls 82, 84 are perpendiculaer to the upper surface of member 70. The height of wall members 82, 84 being equal and is of importance in allowing the free movement of slide member 41 when considering the mounting of the locking mechanism 90 (shown in FIGS. 8 and 9) which will be explained below.

Figure 5B:
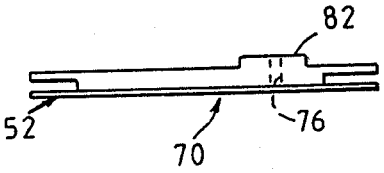
FIG. 5B is a side elevational view of the basemember shown in FIG. 5A.

Additionally, it is seen when referring to FIGS. 5A, 5B, that base member 70 has an apperture 76 passing thru it having a center located at a point on its longitudinal axis in a location at or near the center of channel section 80.

Figure 6:
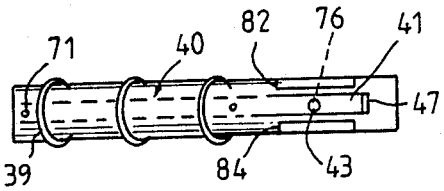
FIG. 6 is a top plan view of the basemember shown in FIG. 5A with a binder mechanism, including a slidable member, mounted thereon having its rings in a closed position.

Binder mechanism 40 of the preferred embodiment includes operable slide member 41 as shown in FIG. 6. Binders having operable slide members to facilitate the opening and closing of the document retaining rings 39 are well known in the art. Such a binder is sold by Boorum and Pease of Newark, N.J. as Model No. 072-2SP.

A binder having an operable slide member is modified in the following manner. For sake of discussion the jacket 44 of binder 38 is not of importance and therefore will be removed leaving the binder mechanism 40 including operable member 41 as a separate piece of hardware to be discussed herein.

Referring to FIG. 6 it is observed that operable slide member 41 has been modified to include a circular opening 43 formed at point 45 on its longitudinal axis, being setback from the proximate end of slide member 41. The exact location of opening being positioned in proportion to the size of the binder mechanism being utilized. The diameter of opening 43 may be approximately one half the width of slide member 41. Slide member 41 also includes lipped finger grip 47 formed at its end to assist in the opening and closing of ring members 39.

Once binder mechanism 40 and its slide member 41 is so modified it is mounted on base member 70 via permanent attachment methods such as rivets 71 or the like. Upon viewing FIG. 6, once again, it is observed that when mounting binder mechanism 40, on base member 70, slide member 41 is positioned between walls 82 and 84 of channel section 80. It is further observed that apperture 76 and opening 43 are in alignment when the slide member 41 is in its furthest most inward position for closing the binder rings 39 with the slide member 41 being pushed, traveling longitudinally toward ring members 39.

Figure 7:
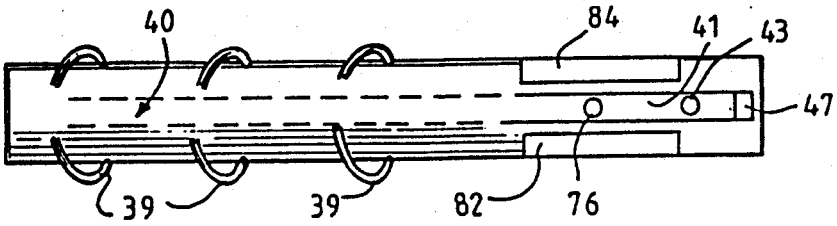
FIG. 7 is a top plan view of FIG. 6 with the binder rings in an open position.

As shown in FIG. 7 when slide member 41 is pulled outwardly, away from ring members 39, thereby opening the rings, apperture 76 and opening 43 are not in alignment.

Figure 8:
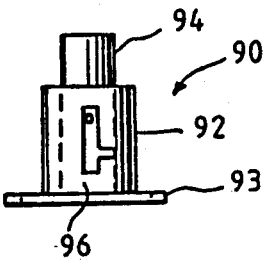
FIG. 8 is a front elevational view of the plunger type lock used in conjunction with the lockable binder of the present invention.

The locking mechanism of lockable binder 14 will now be discussed. Referring to FIG. 8 locking mechanism 90 is of the plunger type which are well known in the art. The plunger lock disclosed in Patent #4,009,599 entitled "Plunger Lock" with slight modification of the flange member 93 can be adapted to be used in the present invention. Other similar types of locks can be applied as well.

FIG. 8 shows that locking mechanism 90 consists basically of housing 92 having a movable shell 94 capable of changing the position of circular bar 96. Bar 96 functions as an extension of shell 94. Initially, with locking mechanism 90 in an unlocked state, bar 96 is in a retracted position. Upon pushing shell 94, bar 96 is placed in a locked, extended position. Bar 96 is automatically retracted upon the insertion and turning of a key, thereby unlocking mechanism 90.

Figure 9:
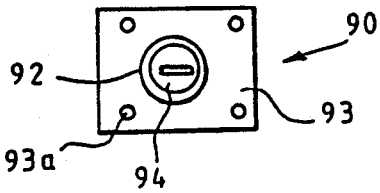
FIG. 9 is a top plan view of the lock shown in FIG. 8.
Figure 10:
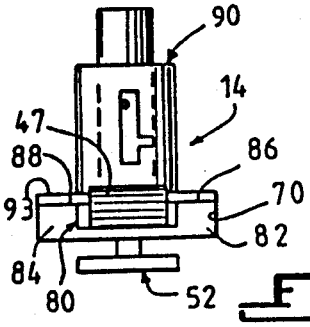
FIG. 10 is a front elevation view of the lockable binder shown in FIG. 4.

Referring to FIGS. 9 and 10 housing 92 of locking mechanism 90 includes flange 93. Flange 93 is formed in a rectangular shape having holes **93*a*. Channel wall edges 86, 88 have mutually aligned receiving holes for accepting one way screws or the like used in mounting locking mechanism 90 on the horizontal, top edges 86, 88 of channel walls 82, 84** respectively.

Figure 12:
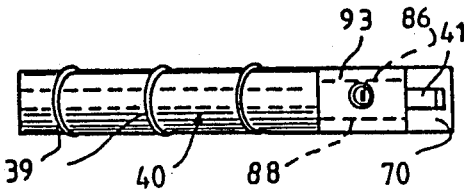
FIG. 12 is a top plan view of the complete binder assembly.
Figure 11:
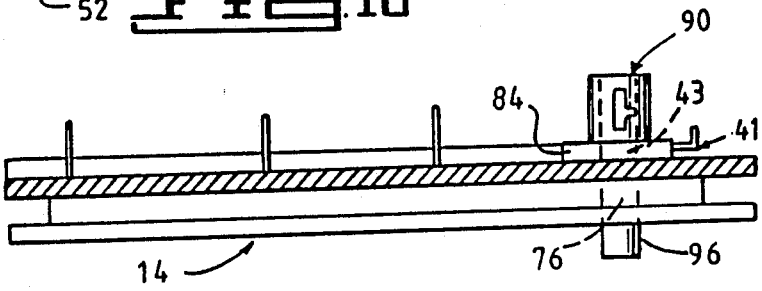
FIG. 11 is a side elevation view of the lockable binder of the present invention with rings closed and its lock in an extended position.

FIGS. 10, 11 and 12 show locking mechanism 90 mounted on the top edges 86, 88 of channel wall section 80 positioning the center point of the end of circular bar 96 in vertical alignment with apperture 76 formed in base member 70. Once locking member 90 is mounted, with shell member 94 having bar 96 in a retracted position, slide member 41 is bounded on four sides with its longitudinal movement unrestrained. Consequently, as shown in FIGS. 11 and 12, opening 43 of slide member 41 is also in alignment with apperture 76 and bar 96 when the slide member 41 is pushed completely in towards the binder mechanism 40 thereby closing the retaining rings 39. In this position shell 94 is capable of being pushed, thereby permitting free movement and extension of bar 96. It should be noted that, in order to provide for unrestricted insertion, circular bar 96 is formed slightly smaller in diameter than opening 43, apperture 76, and keeper hole 19 of the document support stand to be discussed shortly.

At this point lockable loose-leaf binder 14 is assembled as a complete unit, as shown in FIG. 12, and suitable for mounting on the document support stand 2 shown in FIG. 1. As seen in FIG. 3 the mounting is obtained via the cooperation of binder 14 having T-rail member 52 and the support stand 2 having C-bracket 16.

As mentioned previously, document support stand 2 has at least one hole 19 formed in its main body 4. For this embodiment of the invention hole 19 is located at the back plate 18 of C-bracket 16. The purpose of hole 19 is to act as a keeper for bar 96 of lockable loose-leaf binder 14.

Mutual alignment of hole 19, apperture 76 and opening 43 is achieved in the following manner. Referring to stand 2 and binder 14 in FIG. 1 it is seen that the distance from terminated edge 34 of C-bracket 16 to the center point of hole 19 can be made equal, at time of manufacture, to the distance from binder 14's distal end of rail 52 to the center point of circular bar 96. Of course, it is envisioned to have a plurality of holes, such as hole 19, formed in the body 4, along the base member 18 and to have mutual alignment markings on both stand 2 and binder 14 to provide for the locking of a plurality of binders along the same C-bracket 16. A slot terminating edge, such as edge 34 of stand 2 is not necessary for positive locking of binder 14 on the stand.

It is also envisioned to utilize a document support stand with a single slot defining means for holding one or several holders in a plurality of different positions, all holders being mounted on the stand by using the same slot and being capable of being secured in the same manner as the holders previously described. In order to accomplish this the document holders are modified in the following manner.

The document holder 396 includes a T-rail 398 mounted on it. However, the T-rail 398 differs in construction from the T-rails described previously in relation to the other embodiments of the invention.

Figure 13:
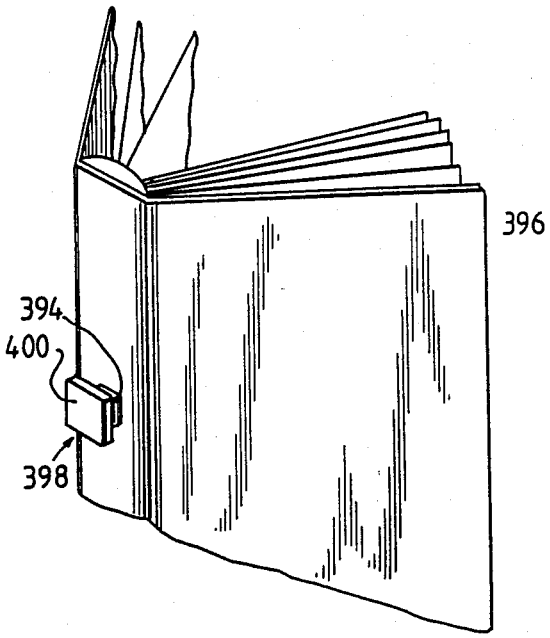
FIG. 13 is a bottom perspective view, partially broken away, of a document holder formed in accordance with the present invention.

As shown in FIG. 13, the holder has a narrowed portion 394 joined to a widened portion 400, but the widened portion 400 of the T-rail 398 has a width and length which are substantially equal to each other and which are equal to or slightly smaller than the widened portion 28 of the T-slot formed in the stand. Similarly, the narrowed portion 394 of the T-rail has a width and length which are substantially equal to each other and which are equal to or slightly smaller than narrowed portion 26 of the T-slot. This configuration of the T-rail will allow the widened portion 400 to be inserted either lengthwise or sidewise into the T-slot.

Accordingly, the T-rail 398 may be formed with a square-shaped widened portion 400, as shown in FIG. 13. A document holder having the square-shaped T-rail mounted on it is thus positionable and lockable on the viewing side of the stand in four different dispositions, depending on how the T-rail is inserted into the T-slot and providing that a cooperating bore or hole 19 is formed in the stand at mutually cooperating locations as shown in FIGS. 1 and 2. Because of the square-shape of the T-rail, the document holder, once mounted on the stand, cannot rotate relative to the stand, and will be maintained in that particular disposition selected at the time it is mounted, until it is removed, turned to a different disposition and remounted on the stand.

Figure 14:
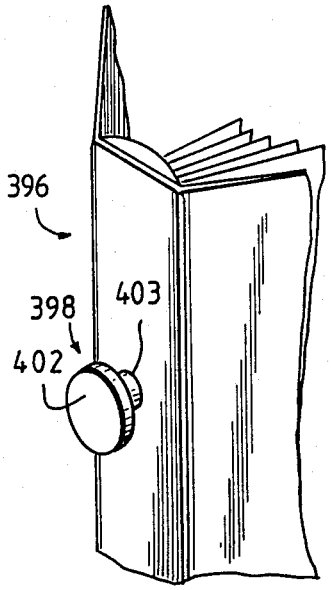
FIG. 14 is a bottom perspective view, partially broken away, of a document holder formed in accordance with the present invention.

Alternatively, the T-rail 398 may be formed with a circular widened portion 402 and a concentrically disposed circular narrowed portion 403, as shown in FIG. 14. Like the square-shaped embodiment described above, the circular widened portion 402 of the T-rail has a diameter which is equal to or slightly less than the width of the widened portion 28 of the T-slot 24 and the circular narrowed portion 403 of the T-rail has a diameter which is equal to or slightly less than the width of the narrowed portion 26 of the T-slot so that the T-rail may be received by the T-slot in any disposition of the T-rail. This allows the T-rail to be rotatable in the T-slot.

A document holder having the circular T-rail mounted on it is thus positionable and lockable on the viewing side of the stand in a number of dispositions. When mounted on the stand, the document holder may be rotated to a different viewing disposition and then secured on the stand. Once the disposition is determined, and a cooperating hole 19 or recessed cavity 21 is engaged, the holder and its documents may be secured in place on the stand. Thus it is envisioned that stand 2 may be provided with a large number of cooperating holes 19 and recessed cavities 21 formed in its body in order to provide for a wide number of selectably lockable dispositions. As with previously discussed embodiments, these holders are also capable of securing not only the holder but also the documents mounted thereon.

Figure 15:
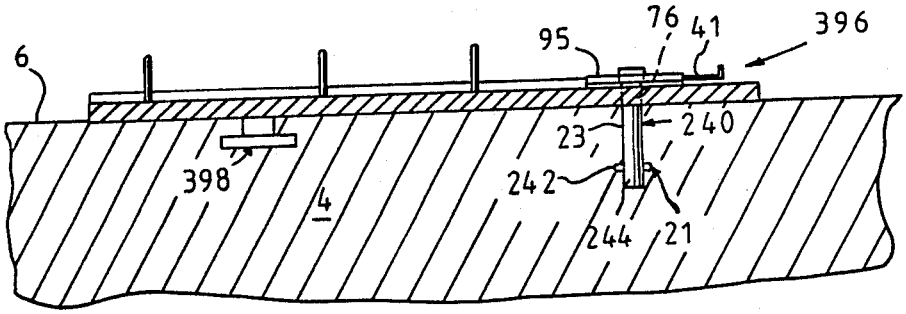
FIG. 15 is a cross-sectional view of an alternative form of locking mechanism which may be used with the document support stand and locking mechanism shown in FIG. 2, taken on line 15—15 of FIG. 2.
Figure 15A:
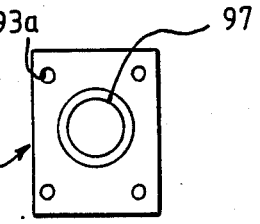
FIG. 15A is a top plan view of the flange member shown in FIG. 15.

It should be noted that in order to insure a secure mounting of the document holder in a number of selectable viewing dispositions a modification in the locking mechanism may be desirable when positioning a binder with its spine perpendicular to the receiving slot of the stand. Referring to FIGS. 2, 15 and 15A the application of an insertable barrel type lock as disclosed in U.S. Pat. No. 4,475,365 is observed. The utilization of such a locking means provides for securing the mounted binder from being pulled by a force normal to the viewing surface. When considering the previously mentioned embodiments, arms 22 of C-bracket 16 provides such security allowing the locking member of those embodiments to secure against longitudinal movement along the path of C-bracket 16. However, when the binder is positioned with its spine not in alignment with the C-bracket of the stand, as shown in FIG. 2, a securing means against forces normal to the viewing surface is provided by a locking device such as barrel lock 240. Barrel lock 240 having pins 242 protruding from shaft 244 are received in corresponding recessed cavity 21 of bore 23 formed in the stand. Several different types of locking devices are envisioned to be suitable for use. Referring to FIG. 15A it is seen that in order to achieve the above, a modification of flange 93 is required. In this particular embodiment flange 93 is modified to form flange 95 which is similar to flange 93 except for the fact that a lock is not mounted on it. Flange 95 is provided with a hole or receiving shoulder 97. Receiving shoulder 97 is formed to accept barrel lock 240. Upon insertion and locking of lock 240 in receiving shoulder 97, with the rings of binder 14 in a closed position, there is mutual cooperation and engagement of operable slide member opening 43, base member apperture 76, bore 23 of stand 2 and recessed cavity 21 of bore 23. The combination so described provides for the secure mounting of both the document and its holder 396 allowing both to be positioned and secured in a number of selectable viewing positions.

Figure 16:
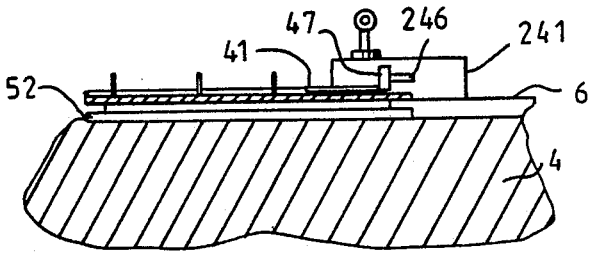
FIG. 16 is a cross sectional view of an alternative form of locking mechanism.
Figure 16A:
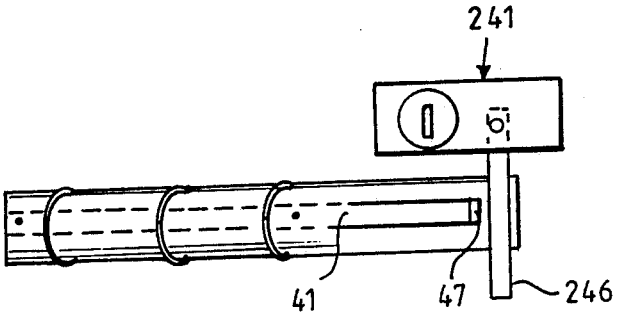
FIG. 16A is a top plan view of the embodiment shown in FIG. 16.

The previous embodiments have provided for the secure mounting of a document holder and its documents either via the document holder carrying a lock or being provided to receive a cooperating locking mechanism. The next embodiment will accomplish the same end by providing a locking mechanism which is permanently affixed to the document support stand. Referring to FIGS. 16 and 16A another type lock mechanism 241 is utilized to accomplish the task of preventing removal of the holder and its documents. Such a lock mechanism is described in U.S. Pat. Nos. 4,462,317 and 4,341,166. With the locking mechanism mounted on the surface of viewing side 6 pivoting plate-like arm 246 is moveable, above and parallel to viewing surface 6, into and out of engagement with finger lip grip 47 of a standard type loose-leaf binder having a sliding member for opening and closing the rings as previously discussed. The only modification that is required of such a binder is that it be equipped with a cooperating member such as T-rail 52 for mounting on stand 2. Upon mounting the binder firmly on the stand, positioning it to the terminated edge 34 of C-bracket 16, arm 246 of locking mechanism 241 is positioned and locked in place abutting lip 47 thereby preventing the removal of the binder or its documents. Thus, a stand having a single slot may be used to mount one or more document holders, having a T-rail as described above, which document holders may be positioned in a plurality of viewing dispositions.

Therefore, thru the cooperation of the above description, lockable loose-leaf binder 14 is now capable of being slidably mounted on stand 2 and locked to the stand with the page retainer rings 39 in a closed, locked position simply by pushing shell 94 of locking mechanism 90 resulting in bar 96 being received by its keeper hole 19 of stand 2 thereby preventing any longitudinal movement of binder 14 and resulting in the positive locking of both binder and documents.

The opening of retaining rings 39 and the unlocking of the lockable binder 14 on stand 2 is achieved simply by the insertion and turning of a key in shell 94 of locking means 90. Unlocking the binder 14 provides for the easy removal and or replacement of pages from the binder and or the dismounting of the binder from the document support stand.

The document support stand and document holders of the present invention allow the user to support a document holder on a stand positioning and locking the document holder, and its documents, in multiple positions for different reading patterns.

The document support stands may be formed from a plastic or other synthetic material, as well as sheet metal or wood. The T-rails 52 and C-brackets 16 may be inexpensively formed of an extruded plastic material.

As is evident from the structures described and shown in the drawings, the document support stands are mechanically simple, with few components, and easily manufactured, and each is adapted to receive and hold a document holder in a number of viewing dispositions.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

I claim:

1. A lockable document holder for being removably mounted and secured on a document support stand, which comprises:

a means for retaining documents, means for supporting the document retaining means, the document retaining means being mounted thereon, and means mounted on the document retaining support means for engageably cooperating with the document holder mounting means of a document support stand;

the document retaining support means including a control means, the control means adapted to retain and release the retaining means, a lock receiving means, wherein the lock receiving means is a mounted flange having an opening, the lock receiving means being situated on the document retaining support means, to allow a lock to cooperate with the support means and the document support stand to secure both the document holder and the document retaining means.

2. A document holder as defined by claim 1, wherein the control means is an operable sliding member.

3. A document holder as defined by claim 1, wherein the document retaining support means is a binder mechanism.

4. A binder mechanism as defined by claim 3, wherein the control means is an operable sliding member.

5. A lockable document holder for being removably mounted and secured on a document support stand, which comprises:

a means for retaining documents, means for supporting the document retaining means, the document retaining means being mounted thereon, and means mounted on the document retaining support means for engageably cooperating with the document holder mounting means of a document support stand;

the document retaining support means including a control means, the control means adapted to retain and release the retaining means, a lock receiving means, the lock receiving means being situated on the document retaining support means, a lock, the lock being mounted on the lock receiving means, to cooperate with the support means and the document support stand to secure both the document holder and the document retaining means.

6. A document holder as defined by claim 5, wherein the document retaining support means is a binder mechanism.

7. A binder mechanism as defined by claim 6, wherein the control means is an operable sliding member.

8. A document holder as defined by claim 5, wherein the control means is an operable sliding member.

9. A document holder as defined by claim 5, wherein the lock receiving means is a mounted flange having an opening.

10. A document holder as defined by claim 5, wherein the lock is a plunger type.

11. In combination:

a document holder, a document retainer, a document support stand for removably mounting the document holder thereon;

means for selectively locking the document holder to the stand, and means for locking the document retainer means to the document holder;

the document support stand including a main body, the main body having a viewing side, and means for mounting a document holder on the viewing side of the body, the document holder mounting means including means defining an elongated slot situated on the viewing side of the body for mounting the document holder on the viewing side;

the document holder including the retainer means, means for supporting the retainer means, the retainer means being mounted thereon, the retainer support means including means for controlling the retainer means, and means mounted on the retainer support means for engageably cooperating with the document holder mounting means of the document support stand to allow the document holder to be mounted on the document support stand;

a lock, a lock receiving means, the lock receiving means including a cooperating means on the document support stand, a cooperating means on the document holder to engageably cooperate with the lock to secure the document holder to the stand and to allow the document retainer means to securably retain the documents being held.

12. A document holder as defined by claim 11, wherein the retaining means is a loose-leaf binder mechanism.

13. A document holder as defined by claim 12, in which said loose-leaf binder mechanism comprises retainer rings, wherein the control means is an operable sliding member for opening and closing the retainer rings of the binder mechanism.

14. A document holder as defined by claim 11, wherein the lock is a plunger type.

15. In combination:

a document holder, a document retainer, a document support stand for removably mounting the document holder thereon;

means for selectively locking the document holder to the stand, and means for locking the document retainer means to the document holder;

the document support stand including a main body, the main body having a viewing side, and means for mounting a document holder on the viewing side of the body;

the document holder including the retainer means, means for supporting the retainer means, the retainer means being mounted thereon, the retainer support means including means for controlling the retainer means, and means mounted on the retainer support means for engageably cooperating with the document holder mounting means of the document support stand;

wherein said means mounted on the retainer support means for engageably cooperating with the document holder mounting means of the document support stand allows the document holder to be positioned in at least two different viewing dispositions;

a lock, a lock receiving means, the lock receiving means including at least two receiving means on the document support stand, the lock receiving means further including a cooperating means on the document holder to engageably cooperate with the lock and lock receiving means of the stand to secure the document holder to the stand and to allow the document retainer means to securably retain the documents being held in at least two different dispositions.

16. A combination as defined by claim 15, wherein said means mounted on the retainer support means for engageably cooperating with the document holder mounting means of the document support stand has a portion which is square in shape.

17. A combination as defined by claim 15, wherein said means mounted on the retainer support means for engageably cooperating with the document holder mounting means of the document support stand has a portion which is circular in shape.

* * * * *